US006357993B1

(12) United States Patent
Burton

(10) Patent No.: US 6,357,993 B1
(45) Date of Patent: Mar. 19, 2002

(54) CONSTRUCTION EQUIPMENT IMPLEMENT AND METHOD

(75) Inventor: Paul Burton, Lee, IL (US)

(73) Assignee: Farmers' Factory Company, Lee, IL (US)

( * ) Notice: Subject to any disclaimer, the term of this patent is extended or adjusted under 35 U.S.C. 154(b) by 0 days.

(21) Appl. No.: 09/502,255

(22) Filed: Feb. 17, 2000

(51) Int. Cl.[7] ..... B66F 9/04
(52) U.S. Cl. ..... 414/724; 414/912; 37/406
(58) Field of Search ..... 414/724, 722, 414/723, 726, 912, 697; 37/403, 405, 406, 409, 410; 91/516, 292, 162, 532

(56) References Cited

U.S. PATENT DOCUMENTS

| | | | | |
|---|---|---|---|---|
| 3,672,521 A | | 6/1972 | Bauer et al. | 214/145 |
| 4,285,628 A | | 8/1981 | Jankowski | 414/739 |
| 4,844,685 A | * | 7/1989 | Sagaser | |
| 4,964,779 A | * | 10/1990 | Sagaser | |
| 5,171,124 A | | 12/1992 | Foster | 414/685 |
| 5,314,292 A | * | 5/1994 | Holopainen | |
| 5,435,117 A | * | 7/1995 | Eggena | |
| 5,472,308 A | * | 12/1995 | Somero | |
| 5,518,359 A | * | 5/1996 | Pratt | |
| 5,544,435 A | * | 8/1996 | Somero | |
| 5,564,506 A | * | 10/1996 | Foster et al. | |
| 5,564,885 A | | 10/1996 | Staben, Jr. | 414/724 |
| 5,607,022 A | * | 3/1997 | Walker et al. | |
| 5,630,476 A | | 5/1997 | Foster et al. | 171/63 |
| 5,639,205 A | | 6/1997 | Kaczmarczyk et al. | 414/723 |
| 5,768,973 A | | 6/1998 | Cochrah | 91/516 |
| 5,924,155 A | | 7/1999 | Broz | 15/83 |
| 5,957,650 A | * | 9/1999 | Rollo | |
| 5,977,778 A | | 11/1999 | Chan et al. | 324/635 |
| 6,098,320 A | * | 8/2000 | Wass | |
| 6,109,859 A | * | 8/2000 | Doman | |
| 6,223,828 B1 | * | 5/2001 | Paulson et al. | |
| 6,267,547 B1 | * | 7/2001 | Lund | |

OTHER PUBLICATIONS

Farmers' Factory Company Brochure, p. 24, Jan., 1999.
Farmers' Factory Company Brochure, p. 26, Jan., 1999.
Farmers' Factory Company Brochure, p. 28, Jan., 1999.

(List continued on next page.)

*Primary Examiner*—Victor Batson
(74) *Attorney, Agent, or Firm*—Leydig, Voit & Mayer, LTD

(57) ABSTRACT

A skid-steer loader implement having a hydraulically actuated grapple component that includes an implement having first and second spaced apart pivot support structures and a hydraulically actuated grapple component pivotally secured to the second pivot support structure. A hydraulically actuated cylinder has one end of the cylinder pivotally secured to the first pivot support structure of the implement and is provided with a moveable piston integrally coupled to an output actuation rod that is pivotally secured at an end remote from the piston to the grapple component. The hydraulically actuated cylinder has supply/return ports adjacent the ends of the cylinder adapted to be alternately coupled to a high pressure hydraulic fluid supply or low pressure hydraulic fluid return. The hydraulically actuated cylinder has valve structure to hydraulically cushion movement of the piston and associated actuation rod as the piston moves past a supply/return port prior to being physically stopped at the ends of the cylinder. The actuation rod is provided with a protective shield to protect the actuation rod surface from hostile environmental intrusions by objects in the vicinity of the actuation rod during actuation. The grapple component includes a pivot shaft portion that is at least as wide or wider than a grapple tooth end of the grapple component. The second pivot support structure is comprised of a pair of bearing support elements spaced apart such that a grapple pivot shaft portion cooperates therewith to create a physical barrier to any material thing that may be gripped between the grapple component and implement.

12 Claims, 8 Drawing Sheets

OTHER PUBLICATIONS

Farmers' Factory Company Brochure, p. 29, Jan., 1999.
Farmers' Factory Company Brochure, p. 30, Jan., 1999.
Farmers' Factory Company Brochure, p. 31, Jan., 1999.
Farmers' Factory Company Brochure, p. 32, Jan., 1999.
Farmers' Factory Company Brochure, p. 33, Jan., 1999.
Farmers' Factory Company Brochure, p. 37, Jan., 1999.
Farmers' Factory Company Brochure, p. 44, Jan., 1999.
Farmers' Factory Company Brochure, p. 49, Jan., 1999.
Farmers' Factory Company Brochure, p. 53, Jan., 1999.
Farmers' Factory Company Brochure, p. 58, Jan., 1999.

* cited by examiner

FIG. 4
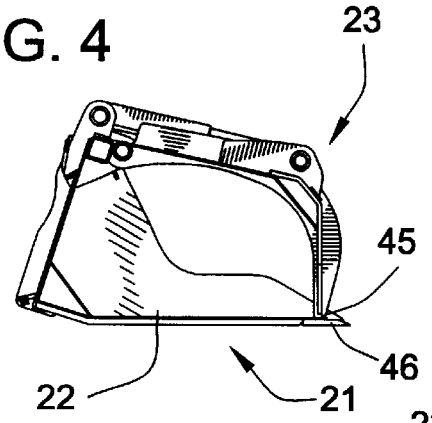
FIG. 5
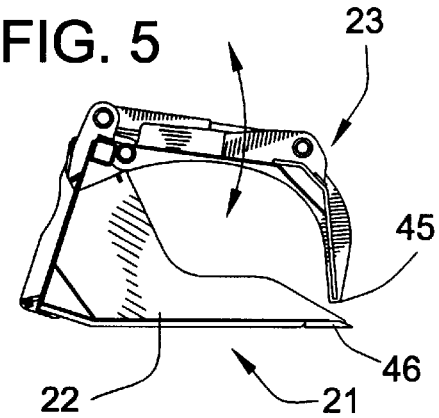
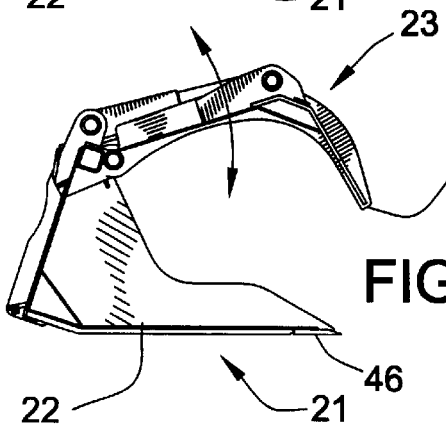
FIG. 6
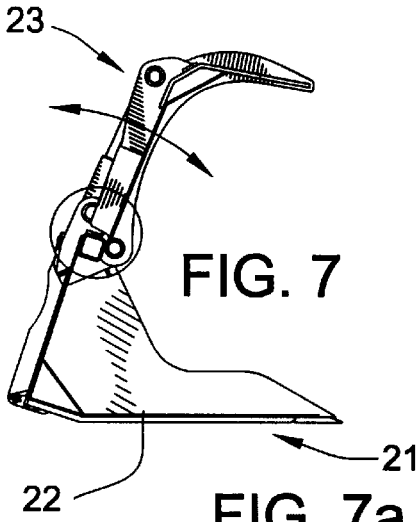
FIG. 7
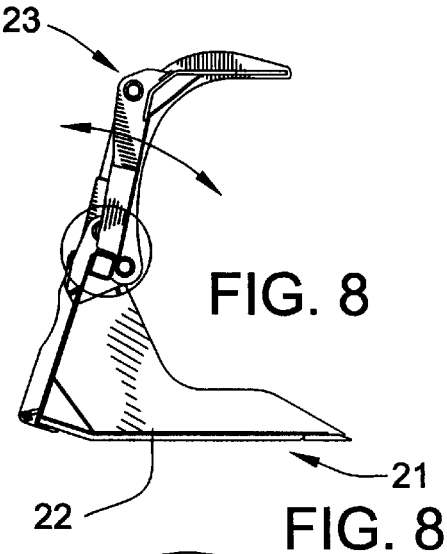
FIG. 8
FIG. 7a
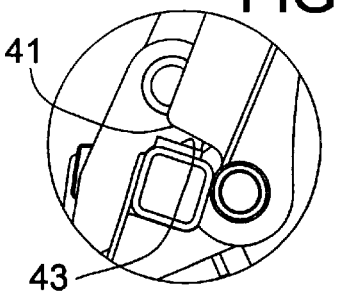
FIG. 8a
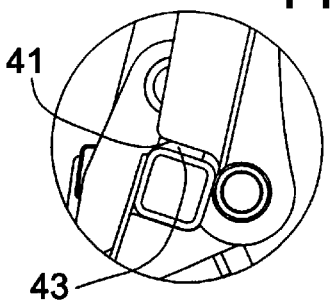

CONSTRUCTION EQUIPMENT IMPLEMENT AND METHOD

FIELD OF THE INVENTION

The invention relates to a construction equipment implement and method of operating a hydraulically activated implement component and more specifically a skid-steer implement having a hydraulically controlled grapple component.

BACKGROUND OF THE INVENTION

Those familiar with the construction industry have long appreciated that construction equipment of the skid-steer front end loader type such as that shown in U.S. Pat. No. 3,231,114, when employed in a variety of different tasks are universally driven aggressively as they execute a multitude of construction chores. The aggressive manner in which skid-steer front end loader equipment is operated flows naturally from the very nature of the implements carried by the skid-steer loader arms. Typical implements include such apparatus as scarp buckets with grapple, single and double grapple buckets and manure forks with grapple to name a few. Each of these implements when secured to skid-steer front end loader arms on the front of the skid-steer loader engage either scrap, debris or other materials disposed or physically distributed along a surface upon which the skid-steer-loader is driven. The skid-steer loader with attached implement is normally driven in an aggressive fashion into materials sought to be moved. The momentum of the skid-steer loader and its attached implement coupled with the sudden reactive forces generated in the material to be moved by the impact of the implement and the material result in the implement being physically filled with the material. In order that the material that has been forced into the implement be held in place when the skid-steer loader moves to another location to deposit the material, the implement may include one or more hydraulically activated components that are pivotally mounted on the implement and move from an open unactuated position to a closed actuated position where the hydraulically actuated component forcefully grips the material between the component and implement to thereby secure the material in place during transit to a location where the material is to be deposited. When a skillful skid-steer loader operator is putting the skid-steer through its paces in the field, an observer of the skid-steer operator and his skid-steer loader will witness a symphony of coordinated activity of operator and skid-steer loader. As is well known, a skid-steer loader is a relatively small four wheel vehicle which is steered by braking or driving two wheels on one side of the vehicle while reversely driving the wheels on the other side of the vehicle. Two laterally spaced loader arms are mounted on the rear of the vehicle to swing upwardly and downwardly and, when the arms are swung downwardly their forward ends extend downwardly in front of the vehicle. A mounting plate is pivotally supported on the forward ends of the loader arms and normally support a construction implement such as a loader bucket. The very nature of the skid-steer loader as described above allows its operator to command the skid-steer loader to move forward and in reverse or to move in a tight circle about braked wheels of the loader while simultaneously opening or closing the hydraulically actuated component that cooperates with material forced into the implement. The most common manner in which the operator commands the hydraulically actuated component to open or close is to move a hydraulic control handle quickly from a fully open or unactuated position to a fully closed actuated position. The hydraulically activated component which is structurally heavy is therefore accelerated to significant velocities which induces momentum forces in the accelerated component. While the hydraulic actuation devices employed in moving the component are designed to move the component through a finite distance, the momentum, that is the mass and velocity of the component causes the component to continue its travel until it strikes a portion of the implement in what is called a hard stop. These hard stops cause the implement and the component to experience significantly high shock loading. The downside of this shock loading manifests itself in structural failures especially in bearings and bearing support structures of the implement and hydraulically actuated component.

To the question can an operator by careful attention to the movement of the hydraulic control lever avoid this shock loading, the answer is yes. In practice however a study of operator movement reveals that the operator may be simultaneously controlling a skid-steer loader movement and operation by the synchronized movement of both hands and feet at the same time. Accordingly normal skid-steer loader operation has the operator operating the loader at top speed to impact material to be carried by the implement and hydraulically actuated component that grips the material. It is not uncommon for the impact of the skid-steer implement with material to be moved to cause some of the material to pass physically through or by the component and implement resulting in damage to the hydraulic actuation apparatus or the skid-steer loader and/or its operator.

Typical of a work attachment or construction component of the type just described is shown in the F. P. Staken U.S. Pat. No. 5,565,885 ('885) issued Oct. 15, 1996. Of particular interest is a work attachment or component that includes a grapple hook mounted on the component by means of a set of two pairs of upstanding pivot brackets formed on the implement at opposite ends of the grapple hook. The grapple hook is caused to move from a fully open unactuated position to a fully closed actuated position by means of a pair of hydraulically actuated cylinders that are pivotally secured to each end of the implement and at the other end thereof to the grapple hook component.

When the grapple hook is moved quickly from an actuated position to an unactuated position severe shock loading is experienced in the pair of upstanding brackets and their respective pivot pins. It is this type of shock loading that eventually causes structural failure between the brackets and the implement of which they are a part. It is also to be noted that an open space between the pivot brackets at the opposite ends of the grapple hook allows ready passage of material being forced into the implement such that the material may pass through the implement and invade a front opening of the skid-steer cab and injure the skid-steer operator. The invention to be described hereinafter completely obviates shock loading problems of the nature experienced in the '885 patent while simultaneously protecting the skid-steer loader operator and the hydraulic cylinder actuation component of the implement.

SUMMARY OF THE INVENTION

Simply stated the principal object of the invention is to provide a method and apparatus that prevents shock load damage to a construction implement when a hydraulically actuated component thereof is quickly driven from a fully actuated to an unactuated position or vice versa.

More specifically the invention is directed to a skid-steer loader implement having a hydraulically actuated grapple component that includes an implement having first and second spaced apart pivot support structures and a hydraulically actuated grapple component pivotally secured to the second pivot support structure. A hydraulically actuated cylinder has one end of the cylinder pivotally secured to the first pivot support structure of the implement and is provided with a moveable piston integrally coupled to an output actuation rod that is pivotally secured at an end remote from the piston to the grapple component. The hydraulically actuated cylinder has supply/return ports adjacent the ends of the cylinder adapted to be alternately coupled to a high pressure hydraulic fluid supply or low pressure hydraulic fluid return. The hydraulically actuated cylinder has valve structure to hydraulically cushion movement of the piston and associated actuation rod as the piston moves past a supply/return port prior to being physically stopped at the ends of the cylinder. The actuation rod is provided with a protective shield to protect the actuation rod surface from hostile environmental intrusions by objects in the vicinity of the actuation rod during actuation. The grapple component includes a pivot shaft portion that is at least as wide or substantially wider than a grapple tooth end of the grapple component. The second pivot support structure is comprised of a pair of bearing support elements spaced apart such that a grapple pivot shaft portion cooperates therewith to create a physical barrier to any material thing that may be gripped between the grapple component and implement.

Another object of the invention is to provide an apparatus that creates a cushioned stop for a hydraulically actuated grapple component of a skid-steer front end loader implement.

Yet another object of the invention is a method of operating a grapple component of an implement such that the speed of movement of the grapple component is slowed prior to reaching extremes of travel of the component established by the physical structure of the implement.

Still, yet another object of the invention is to provide a protective shield for an actuation rod of a hydraulically actuated cylinder in all stages of actuation.

A final object of the invention is to provide a bearing support structure for an implement such that a hydraulically actuated component that cooperates with the implement physically prevents any object handled by the implement and component to intrude past the implement and the component when the implement is in use.

In the attainment of the foregoing objects the invention contemplates as falling within the purview of the claims a skid-steer front end loader implement and a hydraulically actuated grapple component adapted for use with skid-steer loader arms, such that movement of the loader arms causes the implement and the grapple component to move therewith.

The implement when in use with the loader arms has a portion thereof located remote from the loader arms and another portion adjacent the loader arms. The implement portion adjacent the loader arms is provided with first and second spaced apart pivot support structures that have parallel pivot support axes. The hydraulically actuated grapple component is pivotally secured to the second pivot support structure.

At least one hydraulically actuated cylinder that has a tubular shaped barrel closed at one end thereof is pivotally connected at the closed end to a first pivot support structure. The barrel cooperates with a mating actuation piston mounted for reciprocation in the barrel. The actuation piston is integrally secured to one end of an actuation rod which slidably passes through a hermetically sealed opening in the other end of the barrel. The other end of actuation rod is pivotally connected to grapple component for movement therewith. The barrel is provided with a pair of spaced apart supply/return ports though a barrel wall. The supply/return ports are positioned adjacent the ends of the barrel. The closed end of the barrel and an end of the actuation piston cooperate to create a chamber therebetween. Whereas the other end of the actuation piston and the hermetically sealed opening in the other end of the barrel creates another chamber that includes therein the slidable actuation rod.

Alternatively hydraulically coupling one of the supply/return ports to a high pressure supply while simultaneously hydraulically coupling the other supply/return port to a hydraulic return results in a differential pressure existing across the actuation piston and causes the actuation piston and integral actuation rod to move and thereby cause the grapple component to pivotally move relative to the skid-steer implement.

In the most highly preferred embodiment of the invention the actuation piston is configured to cooperate with a supply/return port such that as an end of the actuation piston moves past either supply/return port, return flow of hydraulic fluid through the port is gradually diminished and movement of the actuation piston is cushioned near the end of the actuation piston travel which results in the grapple component experiencing a cushioned stop at both ends of its pivotal travel.

Another feature of the invention involves the actuation rod which has secured thereto at a point adjacent the actuation rod pivotal connection to the grapple component a protective shield member. The protective shield member extends toward the tubular shaped barrel and has an overall length greater than the actuation rod length when the actuation piston and rod are positioned at an end of the tubular barrel nearest the grapple component to be actuated. The protective shield is positioned such that relative movement of the actuation rod allows the protective shield member to continuously cover the actuation rod in all positions of the actuation rods sliding movement.

Another significant feature of the most highly preferred embodiment of the invention involves the structural nature of the grapple component which has a grapple tooth portion that includes a pivot shaft portion that may be wider than an end of the grapple tooth portion that may come in contact with the portions of implement remote from the loader arms when the hydraulically actuated grapple component is in a fully actuated position. The second pivot support structure is comprised of a pair of bearing support ears integrally secured to the implement and spaced apart such that the grapple tooth pivot shaft portion cooperates with the pair of bearing support ears such that the wider pivot shaft portion of the grapple tooth functions as a physical barrier to any material thing or object that may be gripped between the grapple tooth and implement that would damage the skid-steer loader if the grapple material should be forced toward the skid-steer loader absent the wider pivot shaft portion.

Other objects and advantages of the invention will become more apparent from the following detailed description when taken in conjunction with the accompanying drawings.

BRIEF DESCRIPTION OF THE DRAWINGS

FIG. 4 is a side view of an implement and grapple component that embodies the invention here shown with the grapple component in a fully actuated position.

FIG. 5 is a side view similar to FIG. 4 with a grapple component shown just after grapple tooth lift off from the implement or just prior to the grapple tooth reaching a fully actuated position.

FIG. 6 is another side view with a grapple component shown in a partially open position.

FIG. 7. Is a side view of a grapple component just approaching a fully unactuated position.

FIG. 7*a* is a blow up of a portion of FIG. 7 shown in a circle.

FIG. 8 is a side view of a grapple component experiencing a hard stop with the grapple component in a fully unactuated position.

FIG. 8*a* is a blow up of a portion of FIG. 8 shown in a circle.

While the invention will be described in connection with certain preferred embodiments, there is no intent to limit it to those embodiments. On the contrary, the intent is to cover all alternatives, modifications and equivalents as are included within the spirit and scope of the invention as defined by the appended claims.

DETAILED DESCRIPTION OF THE PREFERRED EMBODIMENTS

Figure 1:
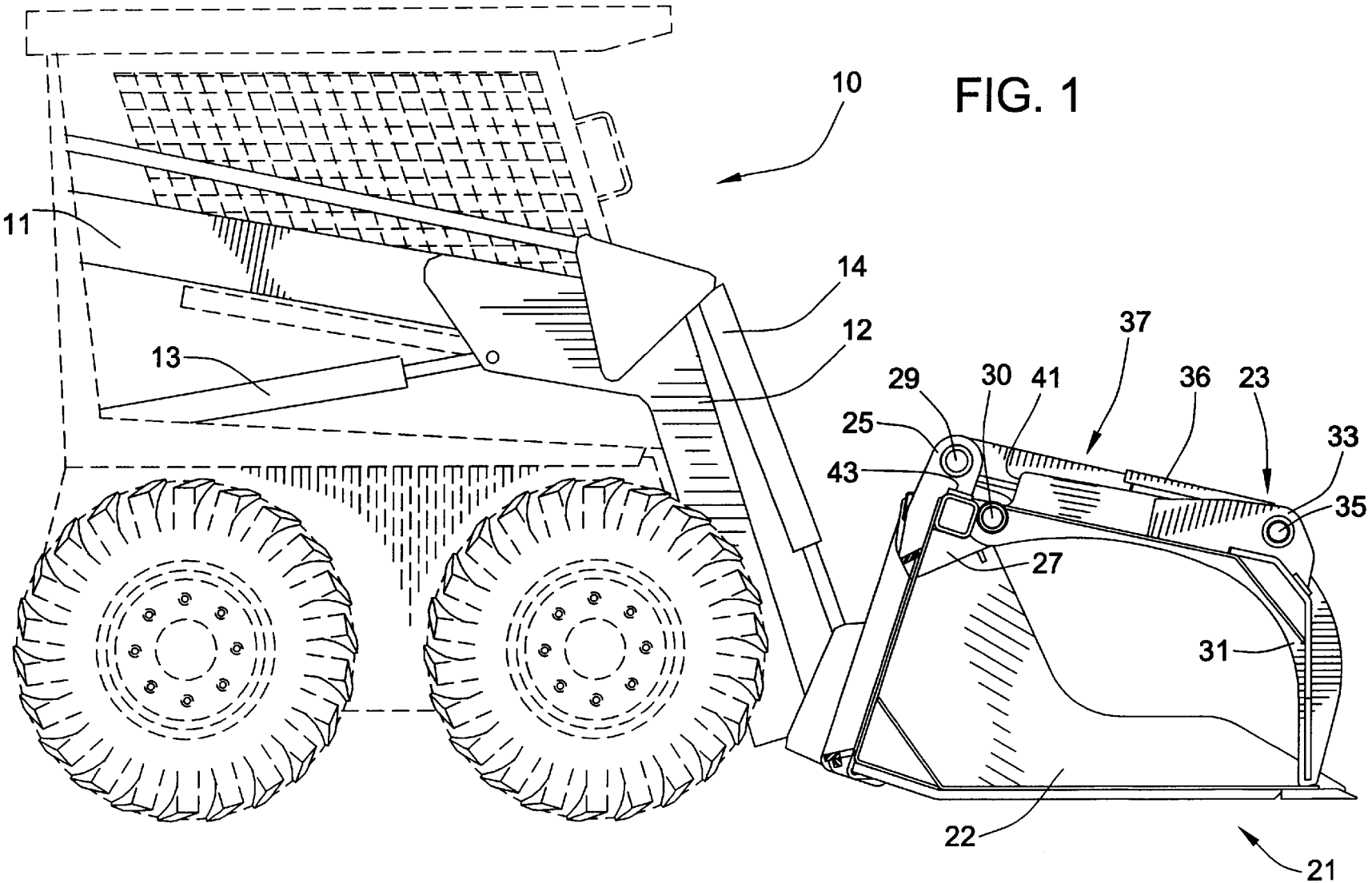
FIG. 1 is a side view illustrating a skid-steer front end loader equipped with an implement and hydraulically actuated grapple component that embodies the invention.

Reference is now made to FIG. 1 which illustrates a skid-steer front end loader generally designated by reference numeral 10. The front end loader 10 is conventional in its construction and includes a hydraulically actuated lift arm 11 coupled as shown to a hydraulic actuator 13. The lift arm 11 is provided with a loader arm 12. A second loader arm, not shown is similarly positioned on the other side of the front end loader. A hydraulic actuator 14 positioned as shown and the loader arms are secured by means not shown to a work attachment 21. The work attachment 21 is comprised of an implement 22 and hydraulically actuated component 21. The detailed structural nature and the manner of operation of the invention embodied in the work attachment 23 will be explained in significant detail hereinafter.

Figure 2:
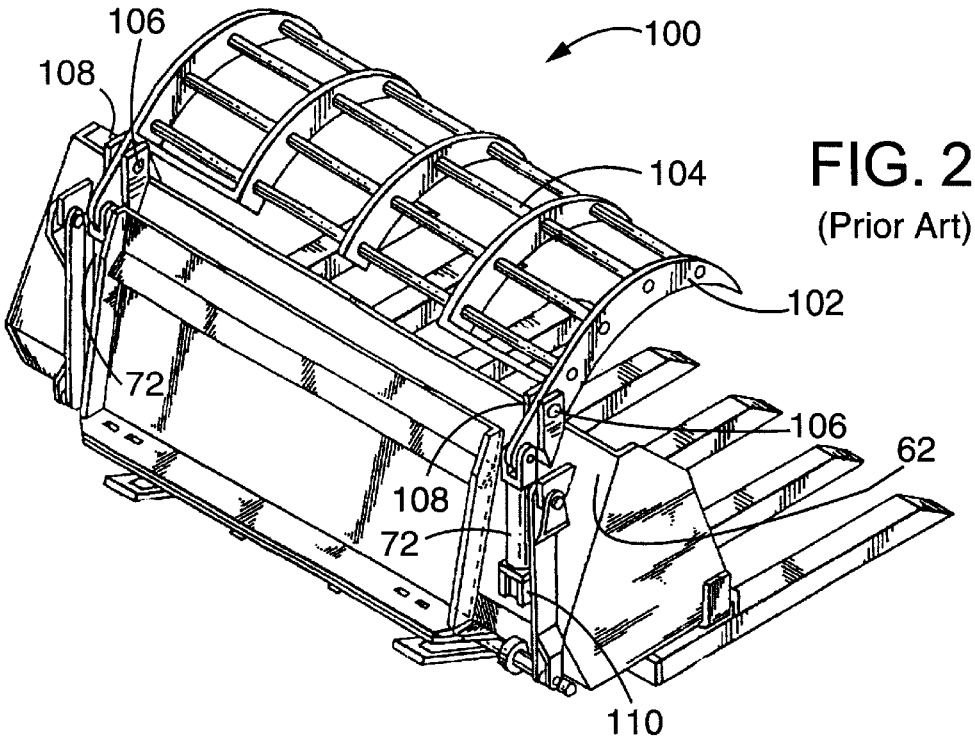
FIG. 2 (Prior Art)
FIG. 2 is a perspective view of a prior art front end loader implement and hydraulically actuated component.

In order that the nature of the instant invention be appreciated, attention is now directed to FIG. 2 in which there is a rear perspective view of a prior art multipurpose work attachment for a front end loader. This multipurpose work attachment is shown in FIG. 7 of U.S. Pat. No. 5,564,885. This work attachment includes a pivotally mounted grapple hook 100. The grapple hook 100 is comprised of a plurality of forwardly and downwardly curved hooks 102 interconnected by lateral cross bars 104, with hooks at opposite ends being connected by pivot pins 106 to an upstanding pair of pivot brackets 108 formed on the rear wall 62 of the bucket. These pivot brackets 108 support the grapple hook for assembly with the hydraulic actuators 72 which can be coupled between the grapple hook 100 and lower mounting brackets 110 on the bucket. Although the actuators 72 are not shown connected to hydraulic lines the actuators respond to an external hydraulic power supply carried by the front end loader. The grapple hook 100 is shown in its open unactuated position. The most common manner of securing pivot brackets 108 to the rear wall 62 of the bucket is by welding the pivot brackets 108 in place prior to installing pivot pins 106. Because the pivot pins 106 and pivot brackets 108 support the grapple hook structure it has been discovered that any misalignment of the pivot axis of the pivot pins at the ends of grapple hook 100 results in a significant twisting stress loading of the pivot brackets 108 when these brackets are secured to the rear wall 62. Ultimately one or both of the pivot brackets crack and may fail where the brackets are secured to the rear wall 62 of the bucket. The invention to be described hereinafter avoids this type of failure. It should also be noted that there is a significantly large open space between the pivot pins and brackets 106, 108 and the grapple hook 100 through which open space material being grasped may invade and jam the operation of the attachment.

Figure 3:
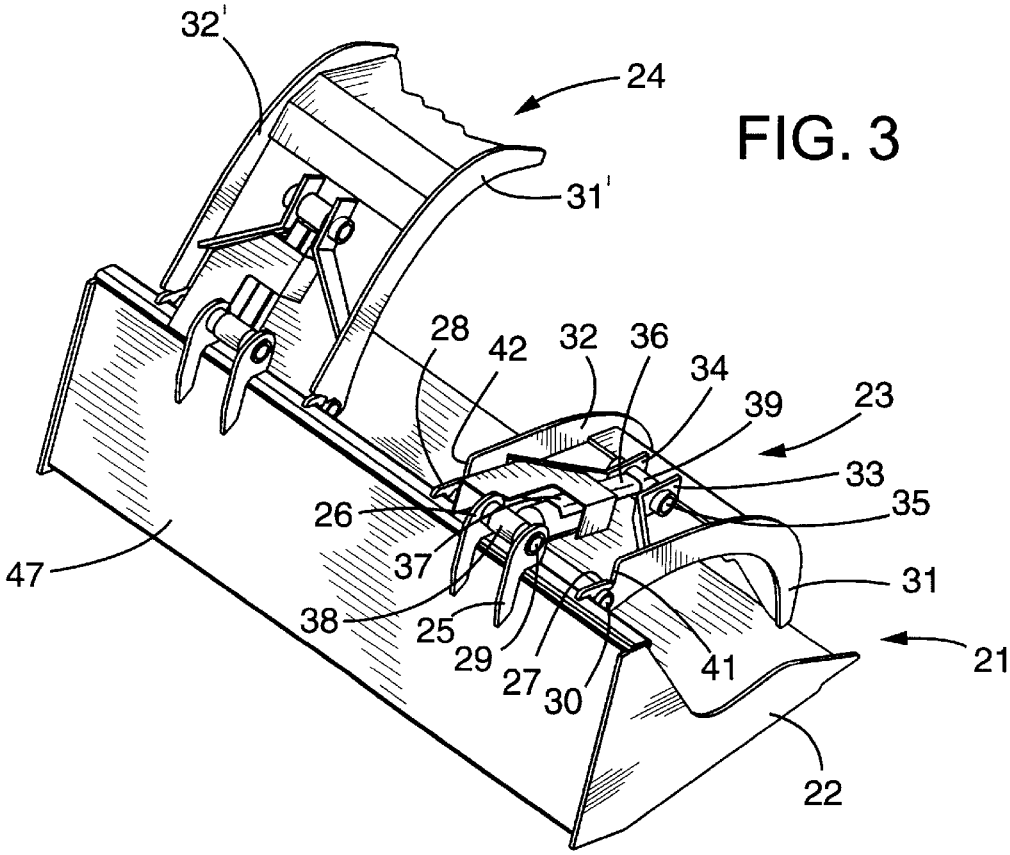
FIG. 3 is a rear perspective view of an implement and hydraulically actuated components that embody the invention.
Figure 9:
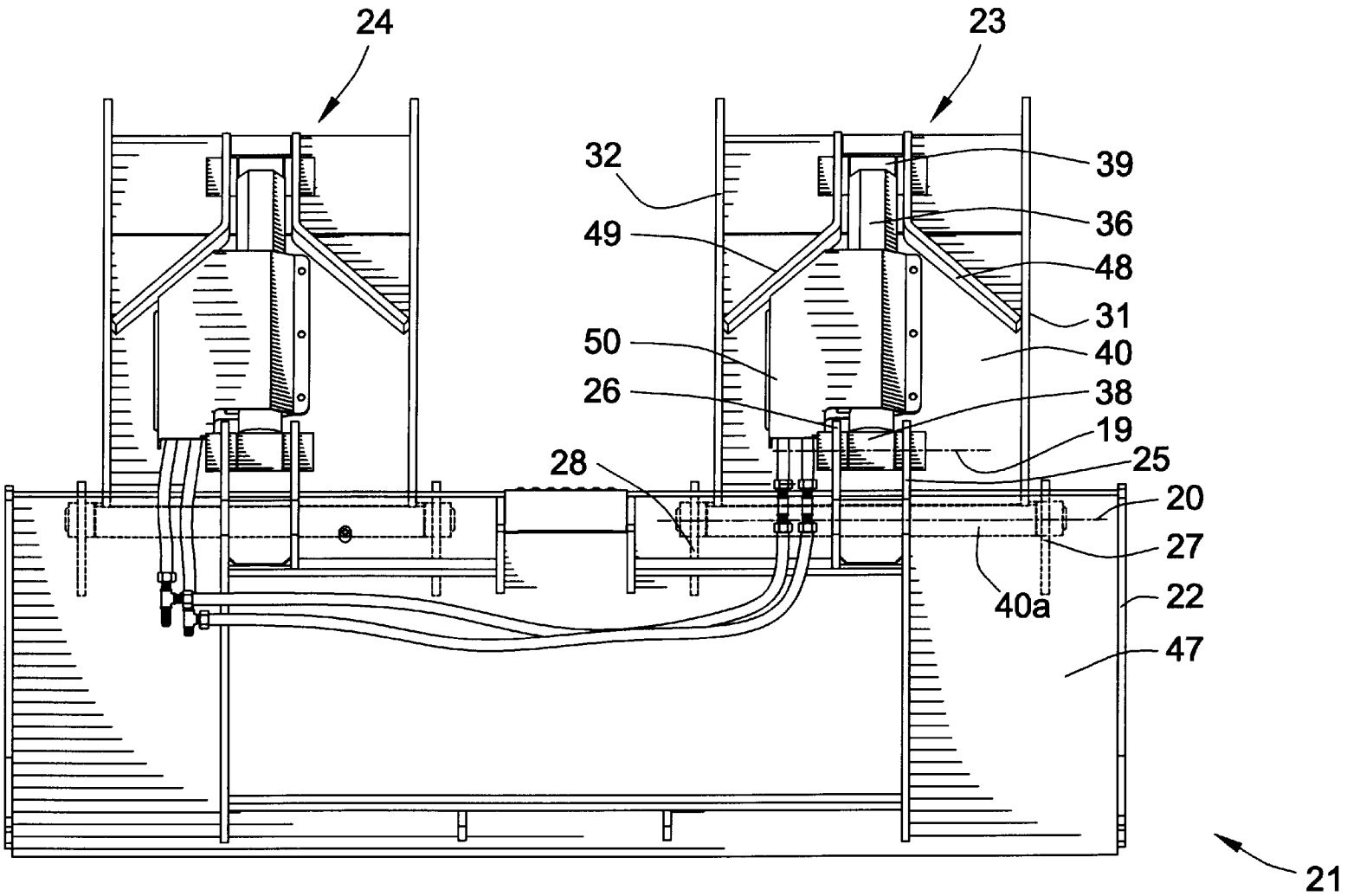
FIG. 9 is a rear plan view of an implement and a pair of grapple components that embody the invention.

FIG. 3 depicts a rear perspective view of a work attachment 21 that is comprised of an implement 22 here shown as a bucket. A pair of hydraulically actuated grapple tooth components 23, 24 are shown with grapple tooth component 23 in a closed or fully actuated position. Whereas grapple tooth component 24 is shown in an open or unactuated position. In FIG. 3 the rear wall 47 of the bucket implement 22 is shown for purposes of illustration only with no structural detail depicted. The missing detail is shown in FIG. 9. This detail is not essential to the practice of the instant invention.

Figure 1A:
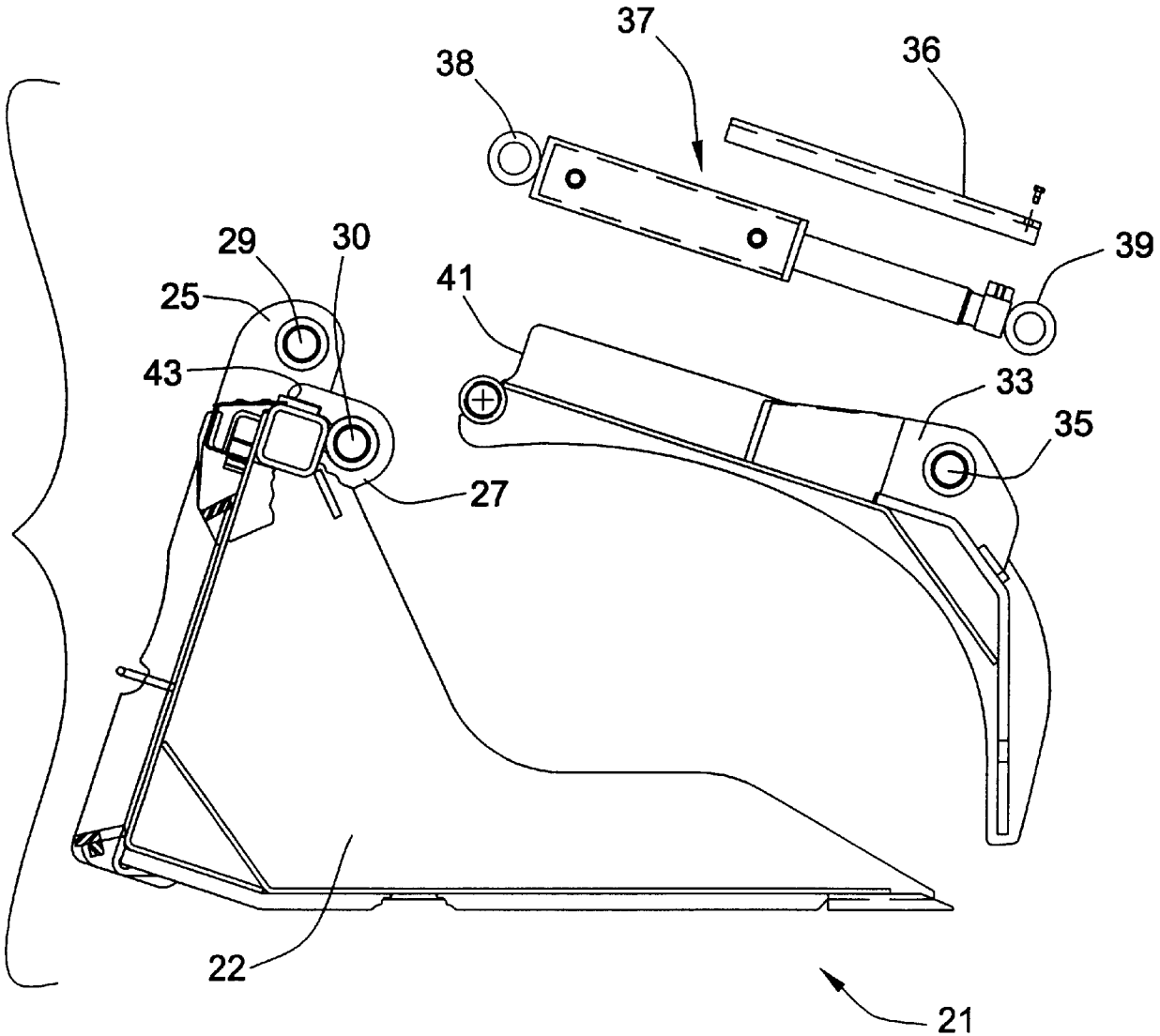
FIG. 1*a* is an unassembled side view of the implement and grapple tooth component of FIG. 1.

In order to appreciate the structural interaction of the various elements of the work attachment assembly 21 of FIG. 1 a description of FIG. 1 and the exploded view of FIG. 1*a* will now unfold. The implement 21 in this preferred embodiment is a bucket. Referring now to FIGS. 1, 1*a* and FIG. 3 it will be seen that the implement 22 has a pair of bucket cylinder ears 25, 26. Only cylinder ear 25 can be seen in FIGS. 1, 1*a* whereas both ears 25, 26 can be seen in FIG. 3. The cylinder ears 25, 26 function as a first pivot support structure. Relatively speaking, the cylinder ears 25, 26 are positioned adjacent the loader arm(s) 12 whereas a second pivot support structure comprised of a pair of pivot ears 27, 28 is positioned on the implement 22 remote from the loader arms. The first pivot support structure includes in addition to the cylinder ears 25, 26 a pivot shaft 29 whereas the second pivot support structure includes in addition to ears 27, 28 a pivot shaft 30. The pivot support shafts 29 and 30 have parallel pivoted support axes. Each of the grapple tooth components 23, 24 include pairs of grapple teeth 31, 32 and 31', 32'. (see FIG. 3) Only the structural details of hydraulically actuated grapple tooth component 23 will be explained in detail hereinafter as the structure of grapple tooth component 24 is identical. Accordingly, the a grapple tooth component 23 is provided with a pair of grapple cylinder ears 33, 34 which are provided with a hydraulic actuator pivot shaft 35 positioned as shown.

When attention is directed to FIGS. 1 and 3 it will be noted that there is a protective actuation rod shield 36 that covers a portion of a hydraulic actuator 37. The hydraulic actuator 37 is pivotally secured at one end thereof by means of pivot shaft 29 that cooperates with hydraulic actuator pivot support structure 38. (see FIGS. 1*a* and 3) The other end of the hydraulic actuator 37 is pivotally secured by means of pivot support shaft 35 that cooperates with the hydraulic actuator pivot support structure 39. A significant feature of the invention involves the manner in which the hydraulic actuator functions. Examples of suitable hydraulic actuators will be explained in detail in reference to the series of illustrations of FIG. 11 and 12. The grapple component 23 is provided with a pair of stop structures 41, 42. Each stop structures cooperates with a stop pad, such as stop pad 43 which is integrally secured to tubular structure 44 which stiffens the implement and is welded to the implement 22 as shown. It should be noted that while a stop pad is shown in the preferred embodiment, the invention is also intended for use in environments where there is no physical stop structure per se.

In order to appreciate the nature of the problems overcome by the subject invention attention is now directed to a series of illustrations namely FIGS. 4, 5, 6, 7, 7*a*, 8 and 8*a* which depict the skid-steer implement and hydraulically actuated grapple component 23 in a series of different operating positions.

The use of reference numerals in conjunction with the description that follows will be minimal as the intention of describing these figures is to explain in part the dynamic environment in which the invention finds utility.

FIG. 4 shows a side view of the implement 21 and its hydraulically actuated grapple tooth component 23 in a closed or fully actuated position. FIGS. 5 and 6 depict the hydraulically actuated grapple tooth 23 moving from a partially actuated position towards an unactuated position. An unreferenced directional arrow indicates the grapple tooth 23 in routine use moves back and forth as is indicated by the directional arrow. The back and forth movement of the grapple tooth 23 is normally very rapid. This rapid movement coupled with the mass of the entire grapple tooth assembly generates large momentum forces that must be accommodated by reaction forces generated in the implement 21 at the extremes of the grapple tooth travel as is shown in FIG. 4 and FIG. 8. While FIG. 4 shows an end of a grapple tooth 45 impacting a leading edge 46 of the bucket implement 22, the grapple tooth need not in practice come in contact with any other portion of the implement. For example when the implement is comprised of fork elements of the type shown in FIG. 2 there might be no physical contact.

FIG. 7 depicts the hydraulically actuated grapple tooth component 23 as it approaches what is termed a hard stop. In FIG. 7*a* there is presented an enlarged view of a circled portion of FIG. 7 where it can be seen that the stop structure 41 is approaching the stop pad 43. Even if a skid-steer operator's reflexes were quick enough to command the hydraulically actuated grapple tooth component 23 to stop its travel, the inertia of the grapple tooth component coupled with inherent physical play between moving parts results in the continued movement of the grapple tooth stop structure 41 into an impact with the stop pad 43 (see FIG. 8). The shock loading experienced in the various pivot support structures is measured by the velocity and mass of the grapple tooth component at the moment of impact. This impact state is most clearly shown in FIG. 8*a*.

There are environments where a hydraulically actuated component such as that depicted in the prior art arrangement of FIG. 2 does not include a physical structure to stop the movement of a hydraulically actuated component. In prior art FIG. 2 the momentum of the grapple hook 100 and the shock loading experienced at the end of the pivotal movement of the grapple hook as it comes to a sudden stop is reacted in the lower mounting brackets 110. Eventually this bracket may experience a fatigue failure.

Figure 10A:
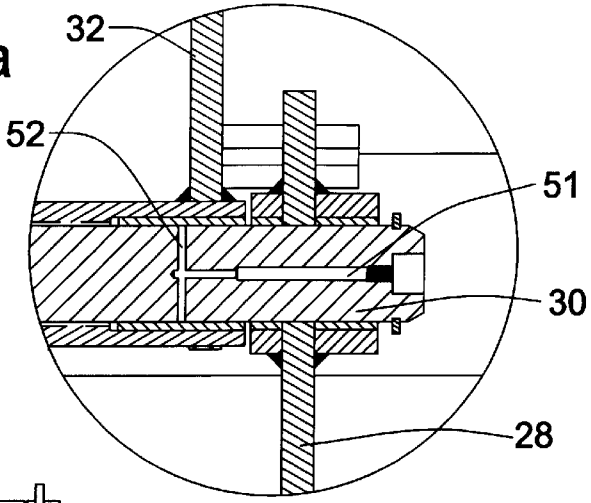
FIG. 10*a* is a blow up of a portion of FIG. 10 shown in a circle.
Figure 10:
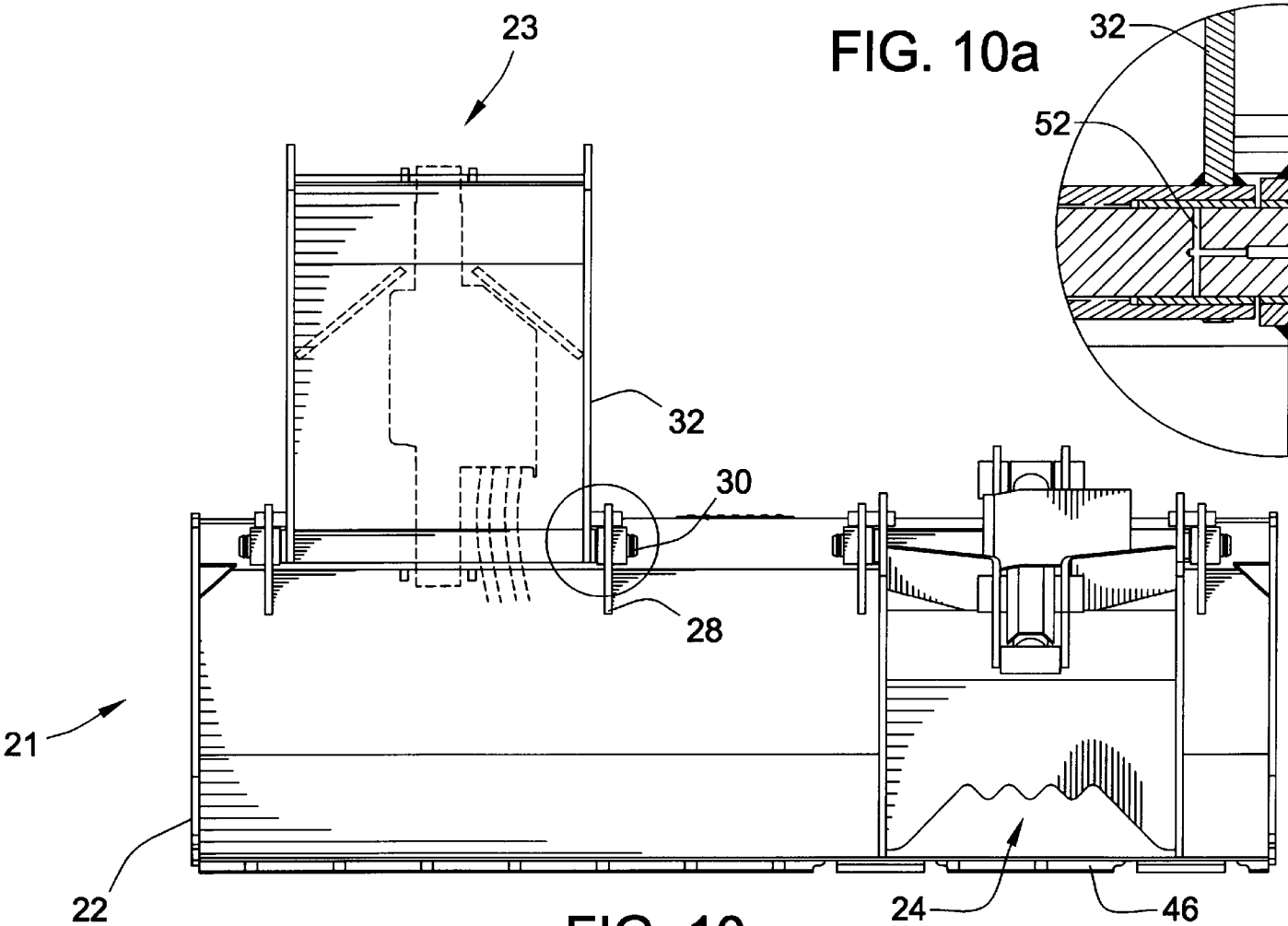
FIG. 10 is a front plan view of an implement and a pair of grapple components that embody the invention.

Attention is now directed to FIGS. 9, 10 and 10*a*. In FIG. 9 there is illustrated a rear plan view of a preferred configuration of a front end loader work attachment 21 embodying the invention that includes a pair of hydraulically actuated grapple tooth components 23, 24 in a raised unactuated position above the implement bucket 22. FIG. 10 differs from FIG. 9 in that it illustrates a front plan view of work attachment 21 with hydraulically actuated grapple tooth component 23 raised above the implement bucket 22 and a fully actuated grapple tooth component 24 positioned as is shown. Normally both hydraulically actuated grapple components 23, 24 operate in unison and FIG. 10 is presented in order that a keener appreciation of the structural detail of the invention maybe studied. Returning now to a description of FIG. 9 and more specifically a brief review of the various structural components that comprise the subject invention. The hydraulically actuated grapple tooth component 23 includes grapple teeth 31, 32. A protective barrier plate 40 is integrally secured to the grapple teeth 31, 32. Structural support webbing 48, 49 is shown integrally secured to the protective barrier plate 40. Hydraulic actuation pivot support structure is mounted on a pivot shaft not referenced in this figure. The protective actuation rod shield 36 of the invention is clearly shown with an unreferenced portion of the protective shield 36 extending under a hydraulic line protective cover 50 not shown in earlier figures but present in the preferred embodiment. Bucket cylinder ears 25, 26 provide a pivotal mount structure for hydraulic actuation cylinder pivot support structure 38. The rear wall 47 of the bucket implement 22 has integrally formed thereon grapple pivot ears 27, 28. Integrally secured to protective barrier plate 40 is a grapple pivot bushing or sleeve portion 40a which has passing there through pivot shaft 30. Pivot support axis 19 and 20 are parallel to each other.

Problems that arise in attempting to axially align pairs of support brackets at the ends of grapple tooth component are diminished significantly by the employment of only two bucket pivot ears 27, 28 rather than four support brackets as is the case with the prior art as is shown in FIG. 2. With the protective barrier plate 40 integrally connected to the grapple pivot bushing portion 40*a* there is established a physical barrier to any material thing that maybe gripped between the grapple component 23 and the bucket implement 22 that would damage the loader 10, hoses, fittings or hydraulic actuator 37 if the gripped material should be forced toward the loader absent the protective plate 40 secured to the pivot bushing portion 40*a*. In the front plan view of FIG. 10 the hydraulically actuated grapple tooth component 23 is shown in a raised unactuated position and FIG. 10*a* represents an enlarge cross-sectional view of the detailed construction of the grapple cylinder ear 28, grapple tooth 32 and pivot shaft 30. Lubrication passages 51, 52 are provided in the pivot shaft 30 and a grease fitting not shown maybe installed in the end of pivot shaft 30. Hardened steel bearing surfaces are also intended to be incorporated in the preferred embodiment of the invention.

Figures 11, 11A, 11B, 11C:
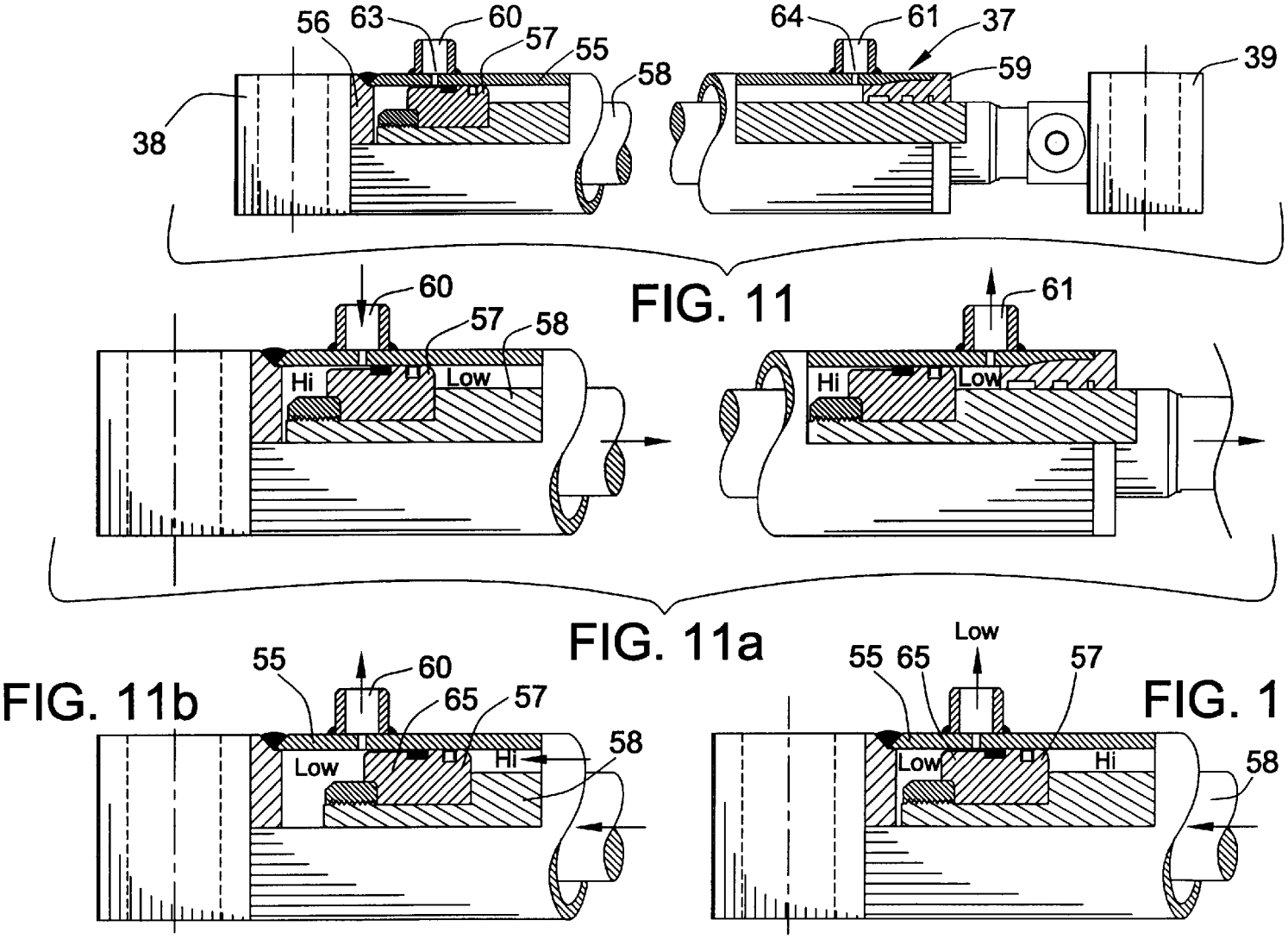
FIG. 11 is a cross-section of a species of hydraulic cylinder that may be employed in the practice of the invention.
FIG. 11*a* is a cross-section of the hydraulic cylinder of FIG. 1 showing an actuation piston in an unactuated and actuated position.
FIG. 11*b* is a cross-section of a piston approaching a cushioned stop.
FIG. 11*c* is a cross-section of a piston experiencing a cushioned stop.
Figure 12:
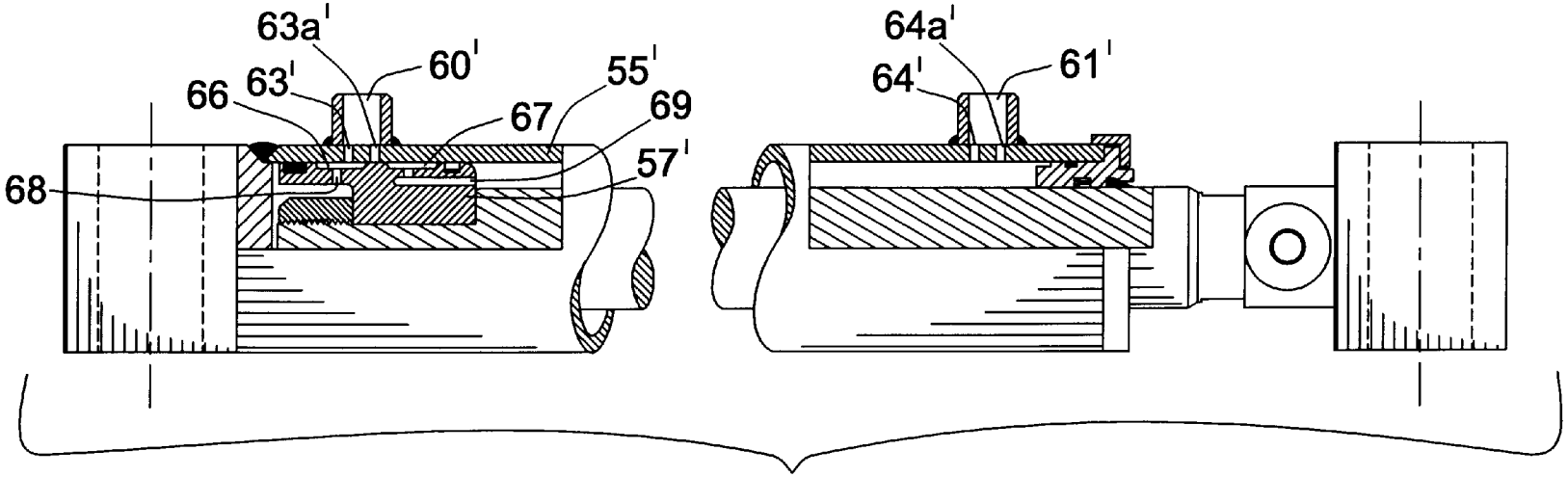
FIG. 12 is a cross-section of another species of hydraulic cylinder that may be employed in the practice of the invention.

FIGS. 11 and 12 illustrate two different types of hydraulic actuation cylinders that maybe utilized in the practice of the invention.

The hydraulic actuation cylinder of FIG. 11 is a species of actuation cylinder that is intended to provide a cushioned stop of a grapple tooth component as the grapple tooth component approaches a raised unactuated position.

The hydraulic actuation cylinder of FIG. 12 is another species of actuation cylinder that will provide a cushioned stop of a grapple tooth component at both actuated and unactuated positions of travel of the grapple tooth component.

In FIG. 11 hydraulic actuator 37 is shown in partial section with pivot support structures 38, 39 disposed at either end thereof. The hydraulic actuator is comprised of a hydraulic actuation cylinder having a tubular shaped barrel 55 which is closed at one end by a plate 56. The inside of the barrel 55 cooperates with a mating actuation piston 57 mounted for reciprocation in the barrel 55. An actuation rod 58 is integrally secured to the piston 57 in the manner shown. The actuation rod 58, as can be seen on the right hand side of FIG. 11, slidably passes through an unreferenced opening in hermetic seal 59. The barrel 55 is provided with a pair of spaced apart supply/return ports 60, 61 which communicate through barrel 55 by means of orifices 63, 64. The closed end of the barrel 55 defined by plate 56, the barrel 55 and the end of the piston 57 establish a chamber on one side of the piston 57. The other end of the piston 57, the barrel 55 and the hermetic seal 59 define another chamber.

Alternately hydraulically coupling one of the supply/return ports 60, 61 to a high pressure supply while simultaneously hydraulically coupling the other supply/return port to a hydraulic return results in a differential pressure existing across the actuation piston and causes the actuation piston 57 and integral actuation rod 58 to move and thereby cause the grapple component to pivotally move relative to the implement 22. The embodiment of the invention as depicted in FIG. 11 has the piston 57 configured to cooperate with the supply/return port 60 such that as an end of the actuation piston 57 moves past the orifice 63 of supply/return port 60, the return flow of hydraulic fluid through the port 60 is gradually diminished and movement of the actuation piston 57 is cushioned near the end of the actuation piston travel which results in the grapple component experiencing a cushioned stop at an end of its pivotal movement.

The detailed nature of the dynamic operation of hydraulic actuation cylinder 37 when in an actuation mode will be understood when FIGS. 11*a*, 11*b* are studied in conjunction with the explanation that follows.

FIG. 11*a* depicts in the left hand portion thereof an actuator piston 57 in an initial position representative of a hydraulically actuated grapple tooth component in an unactuated position. In order to actuate piston 57 an operator in the front end loader will cause a source of hydraulic fluid under high pressure to be delivered to supply port 60 which will cause a high pressure to appear in port 60 and in the chamber to left of piston 57. Simultaneously with the delivery of high pressure hydraulic fluid to supply port 60, port 61 will be connected to a low pressure return. This just describe state will cause a differential pressure to appear across the piston 57 and cause actuation rod 58 to move towards the right. The right hand portion of FIG. 11 shows the piston 57 in a fully actuated position.

FIG. 11*b* is intended to show actuation piston 57 as it approaches a full unactuated position. It is important to note that the left hand end of piston 57 has a slightly reduced diameter 65, here shown in a somewhat exaggerated detail. When a high pressure source of hydraulic fluid is delivered to the right side of piston 57 via supply port 61 (FIG. 11) and port 60 is connected to a low pressure return, the piston 57 and associated actuation rod 58 move towards the left.

FIG. 11*c* shows piston 57 in a full unactuated position where hydraulic fluid in a chamber to the left of piston 57 where hydraulic fluid in the chamber is forced through a space between the reduced outer diameter of piston 57 and the barrel 55. The dynamic action of the forced flow of hydraulic fluid past the reduced diameter piston 65 results in a gradual or soft stop of the piston 57, actuation rod 58 and an attached grapple component described earlier. Although not shown in FIGS. 11, 11*a*, 11*b* and 11*c* it is to be understood that the right hand end of piston 57 could also be provided with a reduced diameter portion of the piston which would provide a cushioned stop when the actuator is commanded to a full actuation.

Figure 13:
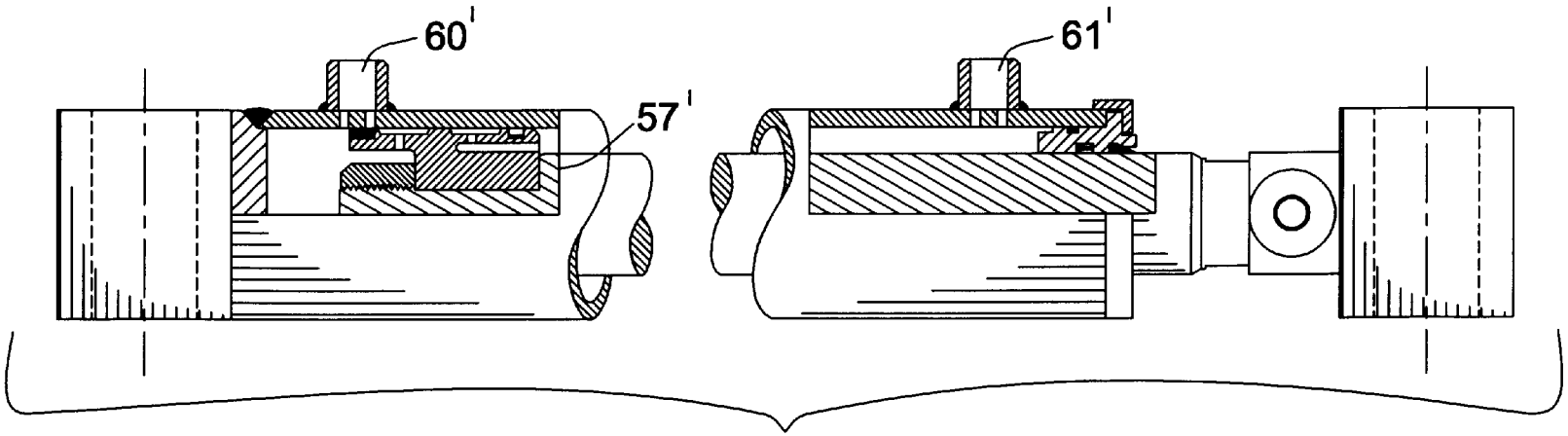
FIG. 13 is a cross-section of the hydraulic cylinder of FIG. 12 approaching a cushioned stop.

FIGS. 12 and 13 are intended to show another piston/barrel configuration that will when employed establish a cushioned or soft stop with both full unactuated and actuated positions. In the description that follows where appropriate similar reference numerals will be employed to designate similar elements, however, a prime mark above the numeral will be added.

Accordingly, the piston 57' shown in FIG. 12 is in an unactuated position as was the piston 57 in FIGS. 11. The piston 57', however, is provided with a pair of reduced diameter regions 66, 67 each of which includes passages 68, 69 that communicate with chamber on both sides of the piston 57'. The barrel 55' is provided with orifices 63', 63*a* that communicate with supply/return port 60' and orifice 64', 64*a'* within supply/return port 61'. The actuation operation of the just described arrangement is similar to that described with reference to FIGS. 11, 11*a*. In FIG. 13 the piston 57' is shown as it approaches a cushioned or soft stop at an unactuated state. When the piston 57' is driven to the right a conditioned or soft stop is experienced at full actuated state.

The just described cushioned stops at the end of an actuation cylinder stroke would also find utility in the angling of a rotary rake, the positioning of a cold planer, backhoe and grader implements for skid-steer loaders to name a few.

What is claimed is:

1. A skid steer implement and hydraulically actuated component adapted for use with skid steer loader arms, such that movement of the loader arms causes the implement and component to move therewith;

the implement when in use with the skid steer loader arms having a portion thereof located remote from the loader arms and another portion thereof adjacent the loader arms;

the other portion of the implement adjacent the loader arms having first and second spaced apart pivot support structures having parallel pivot support axes;

the hydraulically actuated implement component is pivotally secured to the second pivot support structure;

at least one hydraulic actuation cylinder having a tubular shaped barrel closed at one end thereof, the barrel cooperating with a mating actuation piston mounted for reciprocation in the barrel, the actuation piston integrally secured to one end of an actuation rod, the actuation rod slidably passing through a hermetically sealed opening in the other end of the barrel, the other end of the actuation rod pivotally connected to the implement component structure for movement therewith;

the tubular shaped barrel having integral with the closed end thereof a pivot structure pivotally secured to the first pivot support structure of the implement;

the barrel having a pair of spaced apart supply/return ports through a barrel wall, the supply/return ports are adjacent the ends of the barrel, the closed end of the barrel and an end of the actuation piston creating a chamber therebetween, whereas the other end of the actuation piston and the hermetically sealed opening in the other end of the barrel creates another chamber that includes therein the slidable actuation rod;

alternately hydraulically coupling one of the supply/return ports to a high pressure supply while simultaneously hydraulically coupling the other supply/return port to a hydraulic return results in a differential pressure existing across the actuation piston and causes the actuation piston and integral actuation rod to move and thereby cause the implement component to pivotally move relative to the skid steer implement;

at least one end of the actuation piston configured to cooperate with a supply/return port such that as an end of the actuation piston moves past a supply/return port, return flow of hydraulic fluid through the port is gradually diminished and movement of the actuation piston is cushioned near the end of actuation piston travel which results in the implement component experiencing a cushioned stop at an end of its pivotal movement.

2. The skid steer implement and hydraulically actuated component of claim 1 wherein the actuation rod has secured thereto at a point adjacent the actuation rod pivotal connection to the implement component a protective shield member, the protective shield member extending towards the tubular shaped barrel and having an overall length greater than the actuation rod length when the actuation piston and rod are positioned at an end of the tubular barrel nearest the component to be actuated.

3. The skid steer implement and hydraulically actuated component of claim 2 wherein the protective shield member is positioned such that relative movement of the actuation rod allows the protective shield member to continuously cover the actuation rod in all positions of the actuation rod sliding movement.

4. The skid steer implement and hydraulically actuated component of claim 3 wherein the hydraulically actuated component is a grapple tooth component that has a pivot shaft portion wider than an end of the grapple tooth component that may come in contact with the portions of the implement remote from the loader arms when the hydraulically actuated implement grapple tooth component is in a fully actuated position.

5. The skid steer implement and hydraulically actuated component of claim 4 wherein the second pivot support structure is comprised of a pair of bearing support ears integrally secured to the implement and spaced apart such that the grapple tooth pivot shaft portion cooperates with the pair of bearing support ears such that the wider pivot shaft portion of the grapple tooth functions as a physical barrier to any material thing that may be gripped between the grapple tooth component and implement that would damage the skid steer loader and any hoses or fittings or hydraulic actuators that may be secured to the implement if the gripped material should be forced toward the skid steer loader absent the substantially wider pivot shaft portion.

6. The skid steer implement and hydraulically actuated component of claim 5 wherein the implement is a collecting bucket having an upstanding rear wall that in use is adjacent the loader arms.

7. A skid steer implement having a hydraulically actuated grapple component that may be moved physically from a hard stop fully open position to a hard stop fully closed position through an intermediate range of motion between a hydraulically cushioned movement just prior to reaching the hard stops of the fully open and fully closed positions of the component, the skid steer implement and hydraulically actuated grapple component including in combination;

an implement having first and second spaced apart pivot support structures having parallel pivot support axes;

a hydraulically actuated grapple component pivotally secured to the second pivot support structure of the implement;

at least one hydraulic actuation cylinder sealed at one end and including for reciprocating motion therein an integrally connected actuation piston and actuation rod, the actuation rod passing through a hermetic seal at the other end of the cylinder, the sealed end of the cylinder pivotally secured to the first pivot support structure whereas the actuation rod at its end remote from the piston is pivotally connected to the grapple component for movement therewith;

the cylinder having supply/return ports therein adjacent the ends of the cylinder;

alternatively, hydraulically coupling one of the supply/return ports to a high pressure supply of hydraulic fluid while simultaneously hydraulically coupling the other supply/return port to a hydraulic return results in a differential pressure existing across the actuation piston and causes the actuation piston and integral actuation rod to move and thereby cause the grapple component to pivotally move relative to the skid steer implement;

the actuation piston configured to cooperate with a supply/return port such that as an end of the actuation piston moves past a supply/return port, return flow of hydraulic fluid through the port is gradually diminished and the movement of the actuation piston is cushioned near the end of actuation piston travel and prior to experiencing a hard stop at the end of piston travel in the cylinder, the hard stop experienced at the closed cylinder end corresponding to a hard stop fully open position of the grapple component, whereas movement of the piston intermediate the cushioning of the piston movement adjacent the supply return ports establishing the uninterrupted range of motion between the hydraulically cushioned movements of the actuation piston travel, the hard stop experienced at the actuation rod hermetically sealed end of the cylinder corresponding to a hard stop fully closed position of the grapple component.

8. A skid steer loader implement having a hydraulically actuated grapple component, including in combination;

an implement having first and second spaced apart pivot support structures having parallel pivot support axes;

a hydraulically actuated grapple component pivotally secured to the second pivot support structure of the implement;

a hydraulically actuated cylinder having one end of the cylinder pivotally secured to the first pivot support structure of the implement, the hydraulically actuated cylinder being provided with a moveable piston integrally coupled to an output actuation rod that is pivotally secured at an end remote from the piston to the grapple component for movement therewith;

the hydraulically actuated cylinder having supply/return ports adjacent the ends of the cylinder adapted to be alternately coupled to a high pressure hydraulic fluid supply or a low pressure hydraulic fluid return;

the hydraulically actuated cylinder having means therein to hydraulically cushion movement of the piston and associated actuation rod as the piston moves past a supply/return port and prior to being physically stopped at the ends of the cylinder;

the actuation rod having secured thereto at a point adjacent the actuation rod pivotal connection to the grapple component a protective shield member extending towards the actuation cylinder to protect the actuation rod surface from hostile environmental intrusions by objects in the vicinity of the actuation rod during actuation;

the grapple component having a pivot shaft portion that is at least as wide or substantially wider than a grapple tooth end of the grapple component that may come into contact with portions of the implement remote from the implement first and second spaced apart pivot support structures, when the hydraulically actuated cylinder is in a fully actuated position;

the second pivot support structure is comprised of a pair of bearing support ears integrally secured to the implement and spaced apart such that the grapple pivot shaft portion cooperates with the pair of bearing support ears such that the pivot shaft portion of the grapple tooth functioning is a physical barrier to any material thing that may be gripped between the grapple component and implement that would damage a skid steer loader if the gripped material should be forced toward the skid steer loader absent the wider pivot shaft portion.

9. The skid steer loader implement of claim 8 wherein the implement is a collecting bucket having an upstanding rear wall that in use is adjacent loader arms of the skid steer loader.

10. A skid steer loader implement having a hydraulically actuated grapple component, including in combination;

an implement having first and second spaced apart pivot support structures having parallel pivot support axes;

a hydraulically actuated grapple component pivotally secured to the second pivot support structure of the implement;

a hydraulically actuated cylinder having one end of the cylinder pivotally secured to the first pivot support structure of the implement, the hydraulically actuated cylinder being provided with a moveable piston integrally coupled to an output actuation rod that is pivotally secured at an end remote from the piston to the grapple component for movement therewith;

the hydraulically actuated cylinder having supply/return ports adjacent the ends of the cylinder adapted to be alternately coupled to a high pressure hydraulic fluid supply or a low pressure hydraulic fluid return;

the actuation rod having secured thereto at a point adjacent the actuation rod pivotal connection to the grapple component a protective shield member extending towards the actuation cylinder to protect the actuation rod surface from hostile environmental intrusions by objects in the vicinity of the actuation rod during actuation;

the grapple component having a pivot shaft portion that is at least as wide or substantially wider than a grapple tooth end of the grapple component that may come into contact with portions of the implement remote from the implement first and second spaced apart pivot support structures, when the hydraulically actuated cylinder is in a fully actuated position;

the second pivot support structure is comprised of a pair of bearing support ears integrally secured to the implement and spaced apart such that the grapple pivot shaft portion cooperates with the pair of bearing support ears such that the pivot shaft portion of the grapple tooth functioning as a physical barrier to an object that may be gripped between the grapple component and implement that would damage a skid steer loader if the gripped material should be forced toward the skid steer loader absent the wider pivot shaft portion.

11. A method of reducing structural shock loading between a skid steer implement and a hydraulically actuated component carried by the implement when the component is being moved physically from a stopped fully unactuated position of the component to an abrupt stop fully actuated position of the component through an intermediate range of motion between a hydraulically cushioned movement of the component with the implement just prior to reaching the stopped positions of the fully unactuated and fully actuated position, the method including the following steps:

(a) hydraulically actuating the component to move in an uninterrupted manner from any position toward either an abrupt stop fully actuated or an abrupt stop unactuated position (b) hydraulically cushioning movement of the component as the component approaches the abrupt stop fully actuated or unactuated position to thereby reduce structural shock loading between the implement and the hydraulically actuated component.

12. The method of claim 11 the hydraulically actuated component is a grapple that is pivotally mounted on the implement and includes a grapple tooth structure remote from the pivotal mount, the grapple tooth structure normally engaging material to be gripped between the grapple tooth structure and the implement prior to the grapple tooth structure reaching a fully actuated position controlled by the hydraulically cushioned movement of the hydraulic component as the hydraulic component approaches an abrupt stop.

* * * * *